US012559956B2

(12) United States Patent
Mito

(10) Patent No.: US 12,559,956 B2
(45) Date of Patent: Feb. 24, 2026

(54) REBAR TYING TOOL

(71) Applicant: KYOCERA Corporation, Kyoto (JP)

(72) Inventor: Takashi Mito, Fukuyama (JP)

(73) Assignee: KYOCERA CORPORATION, Kyoto (JP)

( * ) Notice: Subject to any disclaimer, the term of this patent is extended or adjusted under 35 U.S.C. 154(b) by 519 days.

(21) Appl. No.: 17/434,010

(22) PCT Filed: Feb. 27, 2019

(86) PCT No.: PCT/JP2019/007520
§ 371 (c)(1),
(2) Date: Aug. 26, 2021

(87) PCT Pub. No.: WO2020/174603
PCT Pub. Date: Sep. 3, 2020

(65) Prior Publication Data
US 2022/0154479 A1 May 19, 2022

(51) Int. Cl.
*E04G 21/12* (2006.01)
*B21F 15/04* (2006.01)

(52) U.S. Cl.
CPC ..... *E04G 21/123* (2013.01); *B21F 15/04* (2013.01)

(58) Field of Classification Search
CPC ..... E04G 21/122; E04G 21/123; B65B 13/04; B65B 13/14; B65B 13/18; B65B 13/285
See application file for complete search history.

(56) References Cited

U.S. PATENT DOCUMENTS

2006/0283516 A1* 12/2006 Nagaoka ..... E04G 21/122 140/119
2007/0227613 A1* 10/2007 Matsuoka ..... B65B 13/185 140/93.6
2017/0335582 A1 11/2017 Machida et al.

FOREIGN PATENT DOCUMENTS

| | | | | |
|---|---|---|---|---|
| CN | 1969101 | A | | 5/2007 |
| CN | 203921254 | U | | 11/2014 |
| CN | 106143983 | A | | 11/2016 |
| EP | 1777360 | A1 | | 4/2007 |
| EP | 2123562 | A2 | | 11/2009 |
| EP | 2301720 | A2 | | 3/2011 |
| EP | 3677736 | A1 | | 7/2020 |
| JP | 6-312381 | A | * | 4/1993 |
| JP | H6312381 | A | | 11/1994 |
| JP | H11169982 | A | | 6/1999 |
| JP | 20062500 | A | | 1/2006 |
| JP | 2008202390 | A | | 9/2008 |
| JP | 2008213069 | A | * | 9/2008 ..... B25F 5/00 |
| JP | 2014166662 | A | * | 9/2014 |
| JP | 2017206302 | A | | 11/2017 |

* cited by examiner

*Primary Examiner* — Christopher L Templeton
*Assistant Examiner* — Paul Derek Pressley
(74) *Attorney, Agent, or Firm* — HAUPTMAN HAM, LLP

(57) ABSTRACT

A rebar tying tool includes a reel housing, a guide, and an antenna. The reel housing houses a reel on which a tying wire is wound. The guide is located frontward from the reel housing to guide the wire drawn from the reel into a loop. The antenna is located inside the reel housing or at a member included in the reel housing.

13 Claims, 7 Drawing Sheets

REBAR TYING TOOL

CROSS-REFERENCE TO RELATED APPLICATION

The present application is a National Phase of PCT Application No. PCT/JP2019/007520, filed on Feb. 27, 2019, entitled "REINFORCING STEEL BAR BINDING MACHINE".

FIELD

Embodiments of the present disclosure relates to a rebar tying tool.

BACKGROUND

Various rebar tying tools are known (e.g., Japanese Unexamined Patent Application Publication No. 2017-206302).

SUMMARY

An rebar tying tool is disclosed. In one embodiment, a rebar tying tool according to an embodiment includes a reel housing, a guide, and an antenna. The reel housing houses a reel on which a wire for tying is wound. The guide is located frontward from the reel housing to guide the wire drawn from the reel into a loop. The antenna is located inside the reel housing or at a member included in the reel housing.

DETAILED DESCRIPTION

Figure 1:
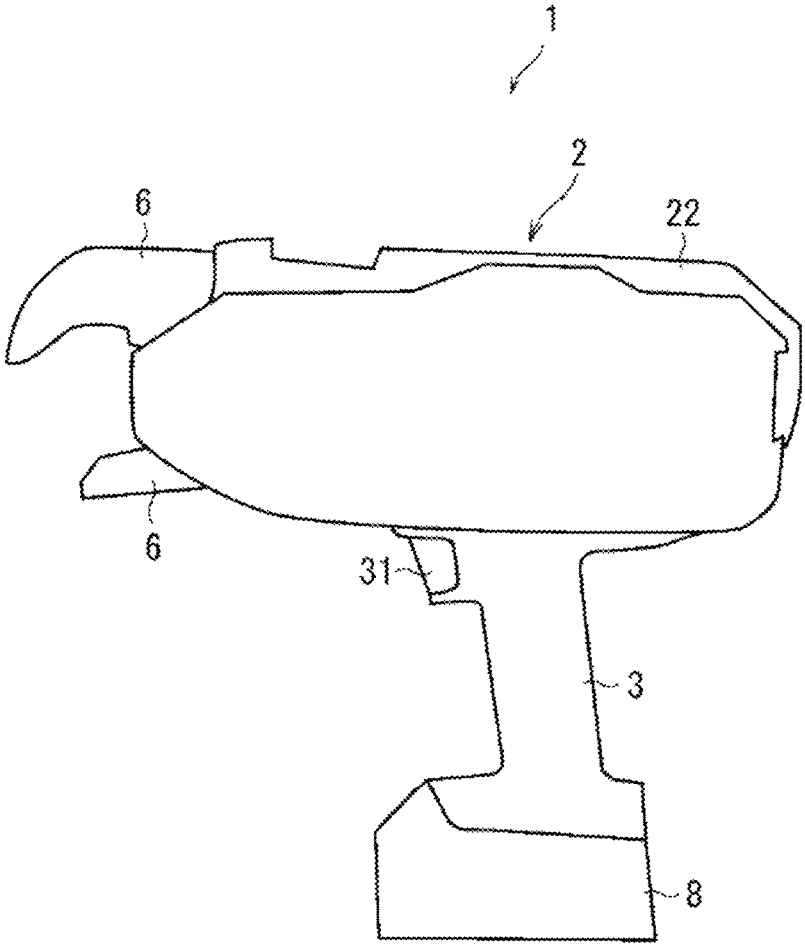
FIG. 1 illustrates a schematic side view of a rebar tying tool in an example.
Figure 2:
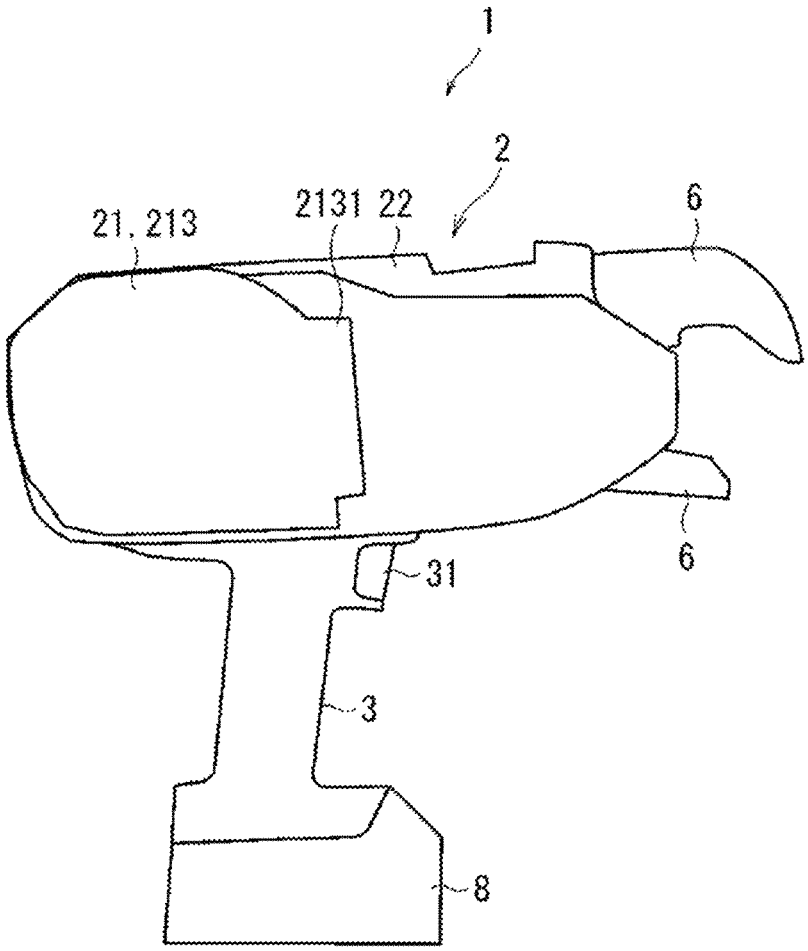
FIG. 2 illustrates a schematic side view of the rebar tying tool in an example.
Figure 3:
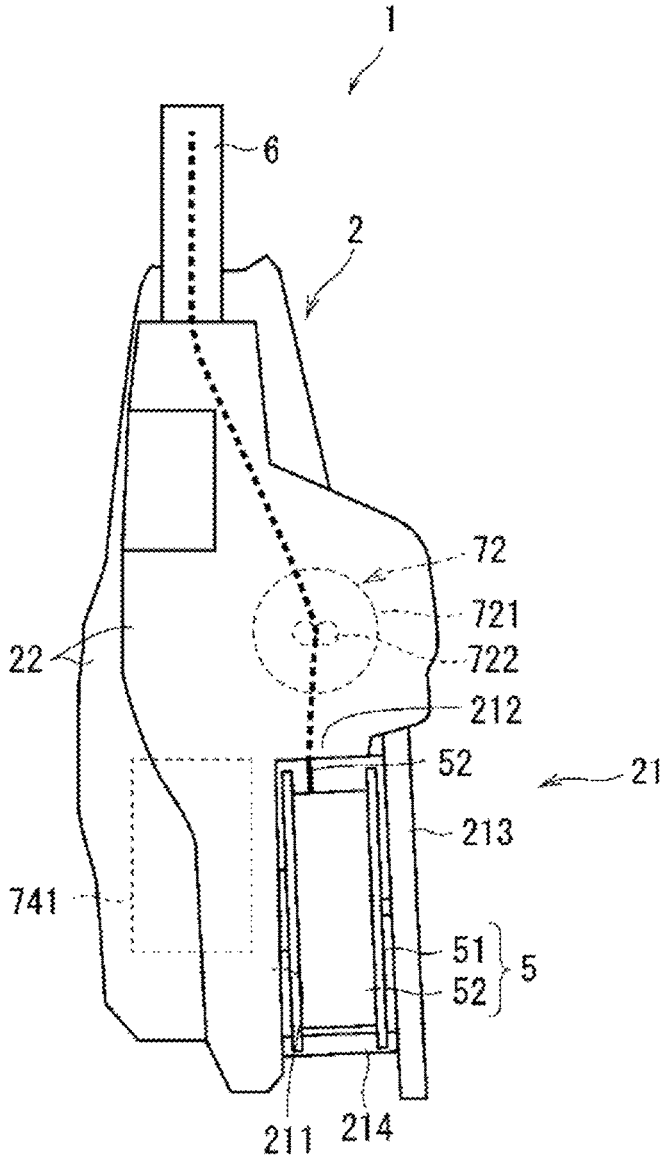
FIG. 3 illustrates a schematic top view of the rebar tying tool in an example.
Figure 4:
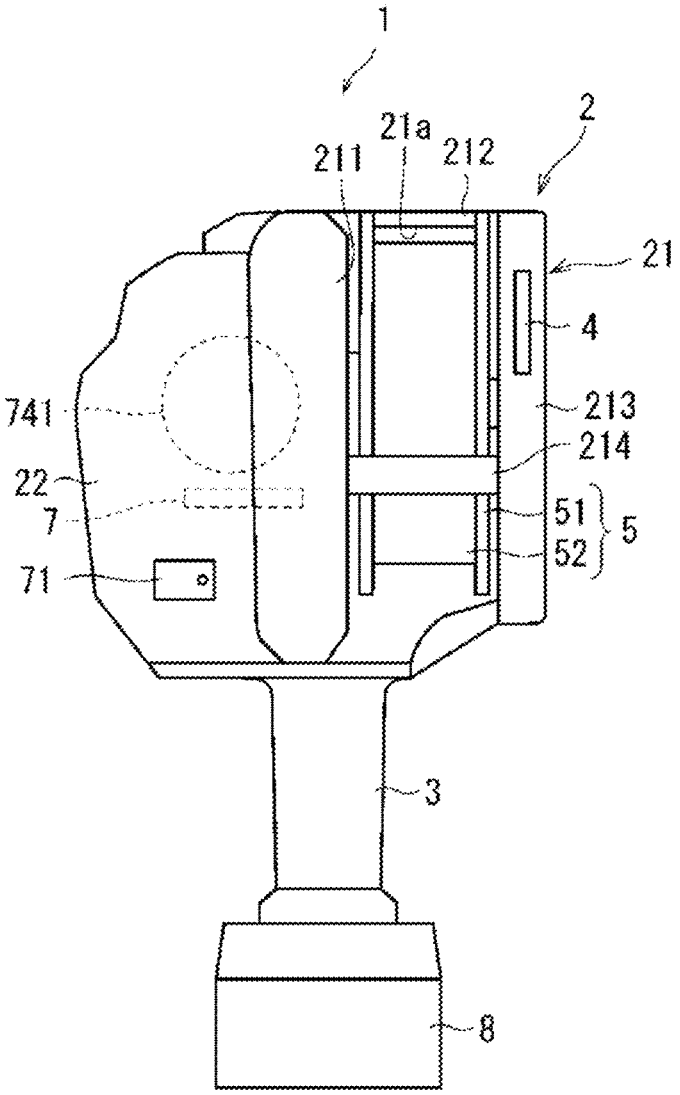
FIG. 4 illustrates a schematic rear view of the rebar tying tool in an example.

FIGS. 1 and 2 are schematic side views of a rebar tying tool 1 in an example. FIG. 3 is a schematic top view of the rebar tying tool 1 in an example. FIG. 4 is a schematic rear view of the rebar tying tool 1 in an example. The positional relationship between the components of the rebar tying tool 1 will be hereafter described using a front-rear direction, a right-left direction, and an up-down direction. These directions are defined with respect to the rebar tying tool 1. Thus, for example, the term up or upward does not always mean vertically upward. The right and the left are hereafter defined with respect to the rebar tying tool 1 viewed from the rear.

The rebar tying tool 1 is a tool for tying multiple reinforcing bars (rebars) with a tying wire. The rebar tying tool 1 also has communication capabilities. The components of the rebar tying tool 1 associated with the typical tying capabilities will first be described briefly, and the components of the rebar tying tool 1 associated with the communication capabilities will then be described.

As illustrated in FIGS. 1 to 4, the rebar tying tool 1 includes a tying tool body 2 and a grip 3. The grip 3 is located under the tying tool body 2. More specifically, the grip 3 extends in the up-down direction, and its upper end is joined to the bottom of the tying tool body 2. An operator can hold the rebar tying tool 1 by gripping the grip 3.

A battery 8 is detachably attached to the bottom of the grip 3. The grip 3 is hollow and accommodates wiring (not shown) in its internal space. The wiring electrically connects various components of the tying tool body 2 (described below) and the battery 8 to one another. The rebar tying tool 1 is driven with power fed from the battery 8.

As illustrated in FIGS. 1 and 2, a trigger 31 may be attached to an upper front portion of the grip 3. The trigger 31 on the grip 3 can be depressed. The operator gripping the grip 3 may depress the trigger 31 with, for example, a forefinger. In response to the trigger 31 being depressed, the rebar tying tool 1 performs an operation for tying rebars.

The tying tool body 2 includes a reel housing 21 and a tying-unit housing 22 (refer in particular to FIGS. 3 and 4). The reel housing 21 and the tying-unit housing 22 are formed from, for example, resin.

The reel housing 21 is located in a rear portion of the tying tool body 2. The reel housing 21 houses the reel 5. The reel 5 includes a reel body 51 and a wire 52 for tying. The reel body 51 is shaped like a drum, on which the wire 52 is wound. The reel 5 is housed in the reel housing 21 in a manner rotatable about the winding core as the axis of rotation. The reel 5 is housed to have the axis of rotation in the right-left direction. As the reel 5 rotates about the axis of rotation, the wire 52 is fed from the reel body 51 into the tying-unit housing 22. A specific example structure of the reel housing 21 will be described in detail later.

The tying-unit housing 22 is located laterally to (e.g., on the left of) and in front of the reel housing 21 and is adjacent to the reel housing 21. The internal space in the reel housing 21 (hereafter may be referred to as the reel housing space) and the internal space in the tying-unit housing 22 connect to each other in the front-rear direction with an opening 21*a* between them (refer to FIG. 4). The wire 52 drawn from the reel 5 is fed into the tying-unit housing 22 through the opening 21*a*.

The tying-unit housing 22 has a pair of guides 6 on its front end. In other words, the pair of guides 6 are located frontward from the reel housing 21. In an illustrated example, the pair of guides 6 have their tips facing each other in the up-down direction and protruding from the tying-unit housing 22 frontward. The wire 52 drawn from the reel 5 is fed to the upper guide 6. As the wire 52 is drawn further, the wire 52 is guided along the inner surface of the upper guide 6 and the inner surface of the lower guide 6 into a loop. In other words, the pair of guides 6 guide the wire 52 into a loop. The rebar tying tool 1 is moved to have multiple rebars placed between the pair of guides 6. In this state, the wire 52 is fed to the pair of guides 6 and surrounds the multiple rebars.

Figure 5:
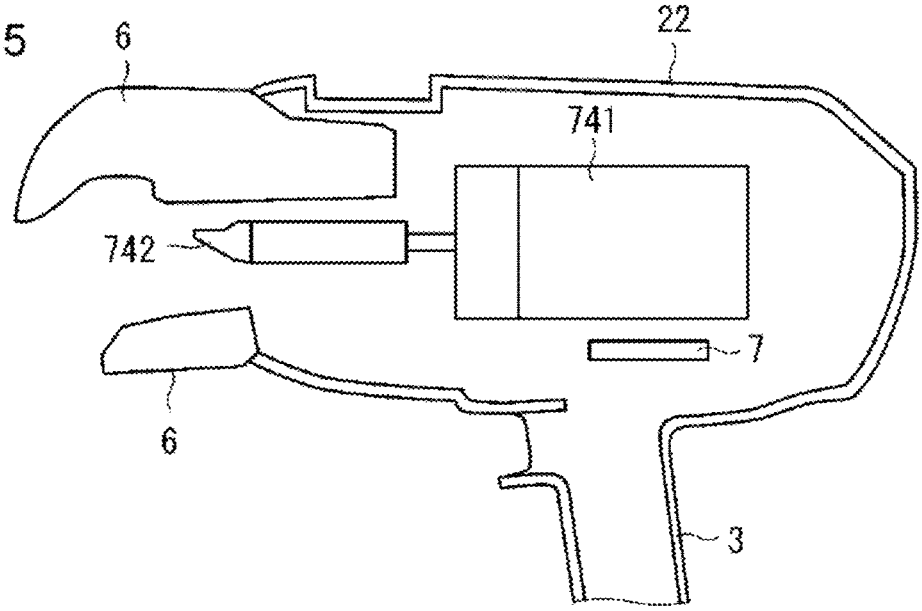
FIG. 5 illustrates a schematic view of the rebar tying tool in an example, showing its internal structure.
Figure 6:
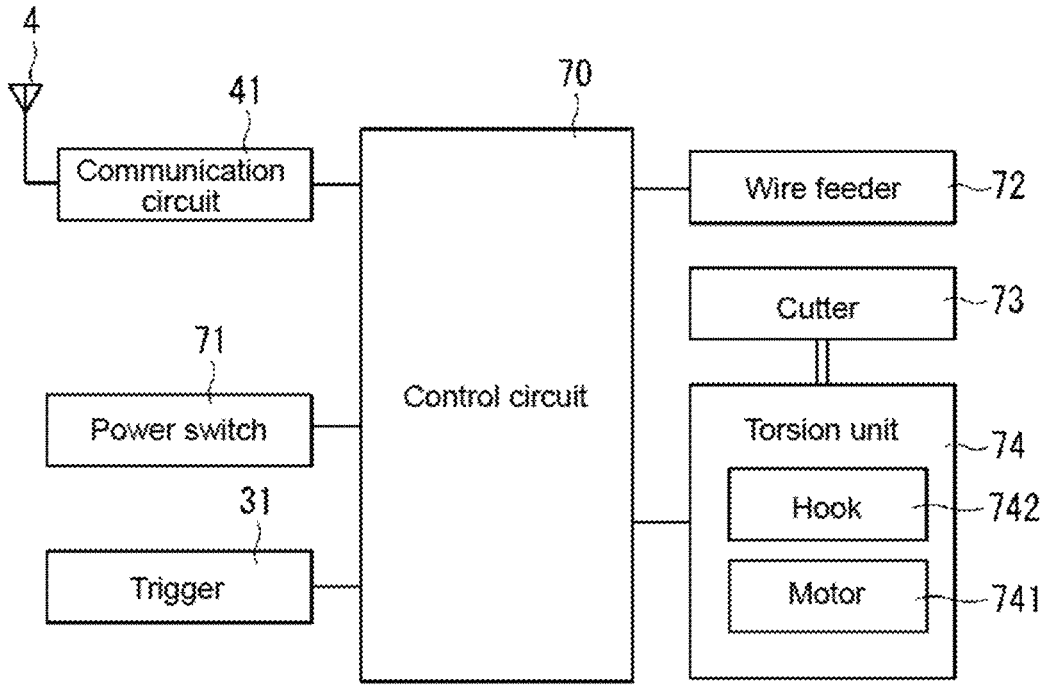
FIG. 6 illustrates a functional block diagram of the rebar tying tool in an example.

FIG. 5 is a schematic view of the tying-unit housing 22 in an example, showing its internal structure. FIG. 6 is a schematic functional block diagram of the rebar tying tool 1, showing its electrical configuration. Referring to FIG. 6, the rebar tying tool 1 mainly includes a wire feeder 72, a cutting unit 73, a torsion unit 74, and a control circuit 70. Although these components can be housed in the tying-unit housing 22, the control circuit 70, the wire feeder 72, and the cutting unit 73 are not shown in FIG. 5 for simplicity.

The wire feeder 72 can feed the wire 52 drawn from the reel 5 and located between the opening 21*a* and the upper guide 6 to the upper guide 6 inside the tying-unit housing 22. The wire feeder 72 may include, for example, a pair of gears 722 that hold, between them, a part of the wire 52 in the longitudinal direction and a feeder motor 721 for rotating the gears 722. The feeder motor 721 is located frontward from the reel 5, and has its axis of rotation in the up-down direction. The gears 722 are located above the feeder motor 721 and connected to the feeder motor 721. When the feeder motor 721 rotates the gears 722, the wire 52 held between the pair of gears 722 is fed onto the upper guide 6. The wire feeder 72 (feeder motor 721) is controlled by the control circuit 70.

The cutting unit 73 can cut the wire 52 looped by the guides 6 and located, for example, between the wire feeder 72 and the upper guide 6 inside the tying-unit housing 22. The cutting unit 73 may include, for example, a cutter that operates in cooperation with the torsion unit 74 (described below).

The torsion unit 74 includes a torsion motor 741 and a hook 742. The hook 742 is between the pair of guides 6 and allows the looped wire 52 to be hooked on it. The torsion motor 741 has its axis of rotation in the front-rear direction and is connected to the hook 742 with, for example, a reducer. Referring also to FIGS. 3 and 4, the torsion motor 741 may be located inside the tying-unit housing 22 in an area adjacent to the reel housing 21 in the right-left direction.

The torsion motor 741 rotates the hook 742 about the axis of rotation. This allows twisting of the wire 52 hooked on the hook 742, thus reducing the diameter of the loop of the wire 52 and tightening the rebars with the wire 52. In other words, the wire 52 can be used to tie the multiple rebars. The cutter in the cutting unit 73 may cut the wire 52 in cooperation with the twisting operation of the torsion unit 74. The torsion unit 74 and the cutting unit 73 are controlled by the control circuit 70.

Referring to FIG. 4, a power switch 71 may be located on a peripheral surface (e.g., a rear end surface) of the tying-unit housing 22. The operator may operate the power switch 71 to turn on or off the rebar tying tool. The power switch 71 is connected to the control circuit 70.

Referring to FIG. 6, the control circuit 70 is also connected to the trigger 31. In response to an operation on the power switch 71 and an input from the trigger 31, the control circuit 70 can control the wire feeder 72, the cutting unit 73, and the torsion unit 74.

The control circuit 70 includes at least one processor to provide control and processing capabilities for implementing various functions, as described in more detail below.

In various embodiments, the at least one processor may be a single integrated circuit (IC), multiple ICs connected to one another for mutual communication, and/or discrete circuits. The at least one processor may be implemented in accordance with various known technologies.

In one embodiment, the processor includes one or more circuits or units that perform one or more data computation procedures or processes by, for example, executing instructions stored in an associated memory. In another embodiment, the processor may be a piece of firmware (e.g., a discrete logic component) to perform one or more data computation procedures or processes.

In various embodiments, the processor may be one or more processors, controllers, microprocessors, microcontrollers, application-specific integrated circuits (ASICs), digital signal processors, programmable logic devices, field-programmable gate arrays, or may include any combination of these devices or components or any combination of other known devices and components, and may implement the functions described below.

All or some of the functions of the control circuit 70 may be implemented with a hardware circuit that can implement such functions without software.

The operator can use the rebar tying tool 1 to tie multiple rebars in the manner described below. The operator first turns on the rebar tying tool 1 by operating the power switch 71. The operator then moves the rebar tying tool 1 to place multiple rebars between the pair of guides 6. In this state, the operator depresses the trigger 31. In response to the trigger 31 being depressed, the control circuit 70 controls the various units described above. More specifically, the control circuit 70 controls the wire feeder 72 to feed a predetermined length of the wire 52 toward the guides 6. This forms the wire 52 into a loop surrounding the multiple rebars. The control circuit 70 then controls the torsion unit 74 to twist the wire 52 while cutting the wire 52. Through the above process, the rebar tying tool 1 can tie the multiple rebars with the wire.

The communication capabilities of the rebar tying tool 1 will now be described. The rebar tying tool 1 further includes a communication circuit 41 and an antenna 4. The antenna 4 allows wireless communication with other communication devices external to the rebar tying tool 1. The antenna 4 may be, for example, a metal sheet (e.g., aluminum foil) with a predetermined pattern. The communication circuit 41 complies with at least one wireless communication standard, and can wirelessly communicate with devices external to the rebar tying tool 1 with the antenna 4.

The communication circuit 41 may comply with wireless communication standards including standards for a wireless local area network (LAN), such as Wireless Fidelity (Wi-Fi). For example, the communication circuit 41 may comply with wireless communication standards including Bluetooth (registered trademark), ZigBee (registered trademark), and Near-Field Communication (NFC). The communication circuit 41 may comply with wireless communication standards including standards for a low-power wide-area (LPWA) network. For example, the communication circuit 41 may comply with wireless communication standards including SIGFOX (registered trademark), a LoRa (registered trademark) wide area network (WAN), and Narrowband Internet of Things (NB-IoT).

The communication circuit 41 includes at least one processor to provide control and processing capabilities for implementing various functions. The at least one processor included in the communication circuit 41 may be implemented in the same manner as the at least one processor included in the control circuit 70 is implemented as described above.

The communication circuit 41 performs various processes including amplification on a reception signal received by the antenna 4 and obtains data from the reception signal. The communication circuit 41 also performs various processes including amplification on a transmission signal including transmission data and wirelessly transmits the resultant transmission signal from the antenna 4.

The transmission data transmitted by the communication circuit 41 to an external device may include operation count data indicating the operation count, or the number of times the rebar tying tool 1 has been in operation. The operation count is measured by the control circuit 70 counting the number of times the trigger 31 has been depressed. The transmission data may also include remaining battery level data indicating the remaining power level of the battery 8. When the rebar tying tool 1 includes a temperature sensor that detects its temperature, the transmission data may include temperature data indicating the temperature of the rebar tying tool 1. The temperature data to be transmitted includes the temperature around the motor or the temperature inside the battery. When the rebar tying tool 1 can identify its position, the transmission data may include position data indicating the position of the rebar tying tool 1. In this case, the rebar tying tool 1 may include, for example, a Global Positioning System (GPS) receiver circuit that obtains position data about the rebar tying tool 1 based on signals from GPS positioning satellites. The GPS receiver circuit may be included in the communication circuit 41 or may be separate from the communication circuit 41. The rebar tying tool 1 may also include, in addition to or instead of the GPS receiver circuit, a circuit for obtaining the position data about the rebar tying tool 1 based on signals from positioning satellites of global navigation satellite systems (GNSSs) other than GPS. Such a circuit may be included in the communication circuit 41 or may be separate from the communication circuit 41. Examples of GNSSs other than GPS include the Global Navigation Satellite System (GLONASS), the Indian Regional Navigational Satellite System (IRNSS), COMPASS, Galileo, and the Quasi-Zenith Satellites System (QZSS).

The transmission data transmitted by the communication circuit 41 to the external device may be generated by the control circuit 70, by the communication circuit 41, or by the control circuit 70 and the communication circuit 41 in cooperation.

The external device may, for example, receive transmission data from multiple rebar tying tools 1 and manage the rebar tying tools 1 based on the received transmission data.

The communication circuit 41 may be mounted on the same substrate 7 as the control circuit 70. In an example in FIG. 5, the substrate 7 is located under the torsion motor 741 in the tying tool body 2. The communication circuit 41 may be mounted on a substrate different from the substrate 7 on which the control circuit 70 is mounted. The antenna 4 may be mounted on the same substrate as the communication circuit 41 or on a substrate different from the substrate on which the communication circuit 41 is mounted.

The communication circuit 41 may transmit other items of transmission data in addition to the data described above. The communication circuit 41 may have either the reception or transmission function.

The rebar tying tool 1 includes the antenna 4 in the reel housing 21. A specific example structure of the reel housing 21 will be described, before an example position of the antenna 4 is described in more detail.

As illustrated in FIGS. 3 and 4, the reel housing 21 may include a first side wall (wall) 211, a front wall (wall) 212, and a second side wall (wall) 213. The first side wall 211 is located at the boundary between the reel housing 21 and the tying-unit housing 22. The first side wall 211 defines the reel housing space in the reel housing 21 and the internal space in the tying-unit housing 22 in the right-left direction. The first side wall 211 is, for example, substantially plate-like and has a thickness in the right-left direction. The first side wall 211 separates the reel housing 21 and the tying-unit housing 22 from each other, and thus can be either part of the reel housing 21 or part of the tying-unit housing 22.

The front wall 212 extends in the right-left direction from a front end of the first side wall 211. The front wall 212 is also located at the boundary between the reel housing 21 and the tying-unit housing 22. The front wall 212 defines the reel housing space in the reel housing 21 and the internal space in the tying-unit housing 22 in the front-rear direction. The front wall 212 is, for example, substantially plate-like and has a thickness in the front-rear direction. The front wall 212 also separates the reel housing 21 and the tying-unit housing 22 from each other, and thus can be either part of the reel housing 21 or part of the tying-unit housing 22. The opening 21*a* is in, for example, an upper surface of the front wall 212 and forms a through-hole in the front wall 212 in the front-rear direction. The wire 52 drawn from the reel 5 in the reel housing space is fed into the tying-unit housing 22 through the opening 21*a*.

The second side wall 213 faces the first side wall 211 across the reel housing space in the right-left direction. The second side wall 213 is, for example, substantially plate-like and has a thickness in the right-left direction. The first side wall 211 and the second side wall 213 sandwich the reel 5 on both sides in the direction of the winding core of the reel 5 (the right-left direction in an example). The second side wall 213 has a front end connected to the front wall 212.

Figure 7:
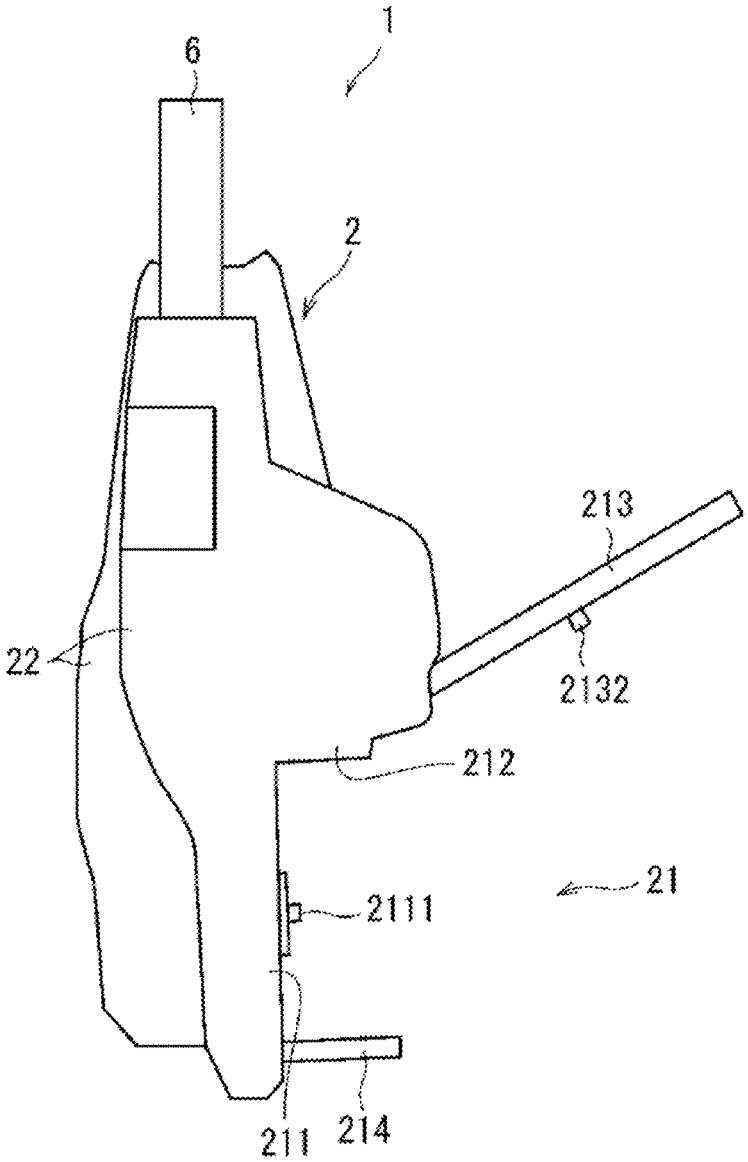
FIG. 7 illustrates a schematic side view of the rebar tying tool in an example, with its open-closed member being open.

The second side wall 213 may be installed in the reel housing 21 in a manner to be open and closed. In a specific example, the second side wall 213 may have its front end attached to the front wall 212 with a hinge 2131 (refer to FIG. 2). The hinge 2131 connects the end of the second side wall 213 to the front wall 212 in a manner pivotable about the axis of pivot in the up-down direction. The second side wall 213 can thus be open and closed like a door. FIG. 7 is a top view of the rebar tying tool 1 in an example, with its second side wall 213 being open. As illustrated in FIG. 7, the second side wall 213 is open about its front end (hinge 2131) in a direction in which its rear end is away from the first side wall 211. The reel housing space is thus open, allowing the operator to attach and detach the reel 5 through the opening. The second side wall 213 may also be hereafter referred to as the open-closed member 213.

As illustrated in FIG. 7, the first side wall 211 may have an attachment protrusion 2111 on its main surface adjacent to the reel housing. The attachment protrusion 2111 protrudes toward the open-closed member 213 in the right-left direction. The open-closed member 213 may have an attachment protrusion 2132 on its main surface adjacent to the reel housing. When the open-closed member 213 is closed (closed state), the attachment protrusion 2132 faces the attachment protrusion 2111 and protrudes toward the first side wall 211 in the right-left direction. The reel 5 has, on both sides of its axis of rotation, recesses to fit the attachment protrusion 2111 and the attachment protrusion 2132. The recesses on the reel 5 fit the attachment protrusion 2111 and the attachment protrusion 2132 to allow the reel 5 to be housed in the reel housing 21 in a rotatable manner.

The reel housing 21 may further include a connector 214. The connector 214 is located rearward from the reel 5. In the closed state, the connector 214 connects the first side wall 211 and the open-closed member 213 to each other. The connector 214 may be rod-like and extends in the right-left direction. The connector 214 has one end connected to the first side wall 211 and the other end removably connected to the open-closed member 213. For example, the other end of the connector 214 and the open-closed member 213 may both include engagement portions. The respective engagement portions are engaged with each other in the closed state to maintain the open-closed member 213 in the closed state.

The connector 214 may not have the other end removably connected to the open-closed member 213. For example, the connector 214 may have the other end fixed to the open-closed member 213 and may have one end removably connected to the first side wall 211.

As illustrated in FIG. 4, the antenna 4 in this reel housing 21 may be located at the open-closed member 213. More specifically, the antenna 4 may be located on one surface of the open-closed member 213. In this case, the antenna 4 may be covered with an insulating protective member. This protects the antenna 4 from the external environment. In some embodiments, the antenna 4 may be embedded in the open-closed member 213.

The antenna 4 in the reel housing 21 can perform more reliable communication in the manner described below.

More specifically, the reel housing 21 is located above the grip 3 as described above (refer to FIG. 4). For comparison, the structure in which an antenna is located on the grip 3 will now be described. The grip 3 is gripped by a hand of the operator. The antenna can also be covered by the hand of the operator, possibly causing less reliable communication. In contrast, the rebar tying tool 1 includes the antenna 4 located in the reel housing 21. The hand of the operator gripping the grip 3 can be at a larger distance from the antenna 4, thus reducing the likelihood of less reliable communication. In other words, this structure allows more reliable communication.

Further, the reel housing 21 is located nearer the rear end than the guides 6 as described above. This structure also allows communication with higher performance. For comparison, the structure in which an antenna is located near the guides 6 will now be described. As described above, multiple rebars are placed between the pair of guides 6 during the tying operation. The rebars are conductive. When the antenna approaches the rebars, the antenna may perform less reliable communication. In contrast, the rebar tying tool 1 includes the antenna 4 located in the reel housing 21. This allows the antenna 4 to be at a larger distance from the guides 6, and thus allows the antenna 4 to be at a larger distance from the rebars during the tying operation. This reduces the likelihood of less reliable communication during the tying operation. In other words, this structure allows more reliable communication.

The antenna 4 may be located in the reel housing 21 or may be embedded in members included in the reel housing 21 (in any of, for example, the first side wall 211, the front wall 212, the open-closed member 213, and the connector 214). Although the antenna 4 may be at any position in the reel housing 21, the position of the antenna 4 in a specific example will be described.

For example, the antenna 4 may be in a rear area of the reel housing 21. In other words, the antenna 4 may be located in an area nearer a rear end (e.g., a rear end surface of the first side wall 211 or the open-closed member 213) than a front end (e.g., the front wall 212) of the reel housing 21. In other words, the antenna 4 may be located in an area rearward from the middle of the reel housing 21 in the front-rear direction. In a specific example, as shown in FIG. 4, the antenna 4 may be located on a rear end surface of the open-closed member 213. This structure allows the antenna 4 to be at a still larger distance from the guides 6, and thus allows the antenna 4 to be at a still larger distance from the rebars during the tying operation. This structure allows still more reliable communication.

Further, the antenna 4 may be located in an upper area in the reel housing 21 (an area opposite to the grip 3). In other words, the antenna 4 may be located in an area nearer an upper end than a lower end of the reel housing. In other words, the antenna 4 may be located in an area upward from the middle of the reel housing 21 in the up-down direction. In a specific example, the antenna 4 may be located on an upper end surface of the open-closed member 213. This structure allows the antenna 4 to be at a still larger distance from the grip 3. This structure allows still more reliable communication.

The structure in which the antenna 4 is located at the open-closed member (second side wall) 213 as illustrated in FIG. 4 allows still more reliable communication as described below.

In an above example, the torsion motor 741 in the torsion unit 74 may be located inside the tying-unit housing 22 in an area adjacent to the reel housing 21 in the right-left direction (refer to FIGS. 3 and 4). Thus, the first side wall 211 of the reel housing 21 is relatively near the torsion motor 741, whereas the open-closed member (second side wall) 213 is relatively less near the torsion motor 741.

A drive current flowing through the torsion motor 741 during the tying operation can cause electromagnetic waves to be generated from the torsion motor 741. In the structure in which the antenna is near the torsion motor 741, such a drive current can cause less reliable communication.

In contrast, the antenna 4 may be located at the open-closed member 213, instead of being located at the first side wall 211, to be at a larger distance from the torsion motor 741. The antenna 4 is thus less susceptible to electromagnetic waves from the torsion motor 741. This structure allows still more reliable communication.

The antenna 4 may be located at the first side wall 211, instead of being located at the open-closed member 213. More specifically, the antenna 4 may be located on a surface of the first side wall 211 to which the reel 5 is attached. This structure allows the antenna 4 to be at a smaller distance from the substrate 7 (refer to FIG. 4). This structure thus shortens the wiring length.

The antenna 4 may be located on the surface of the connector 214 or inside the connector 214, instead of being located at the open-closed member 213. The connector 214 is located rearward from the reel 5, allowing the antenna 4 to be at a larger distance from the guides 6.

The connector 214 may be rod-like and extend in the right-left direction as descried above. In this case, the antenna 4 may be located on a rear portion of the surface of the connector 214. For comparison, the structure in which the antenna 4 is located on a main surface of the plate-like second side wall 213 opposite to the reel housing space will now be described. In this structure, the antenna 4 has a space on its right unoccupied by any part of the rebar tying tool 1, but has a space on its left occupied by part of the rebar tying tool 1. In contrast, in the structure in which the antenna 4 is located on a rear portion of the connector 214, the antenna 4 has a space on its rear, and also, for example, below the antenna 4 occupied by less part of the rebar tying tool 1. The parts of the rebar tying tool 1 can possibly obstruct communication capabilities. The antenna 4 located on a rear portion of the connector 214 can thus reduce the likelihood of less reliable communication.

Figure 8:
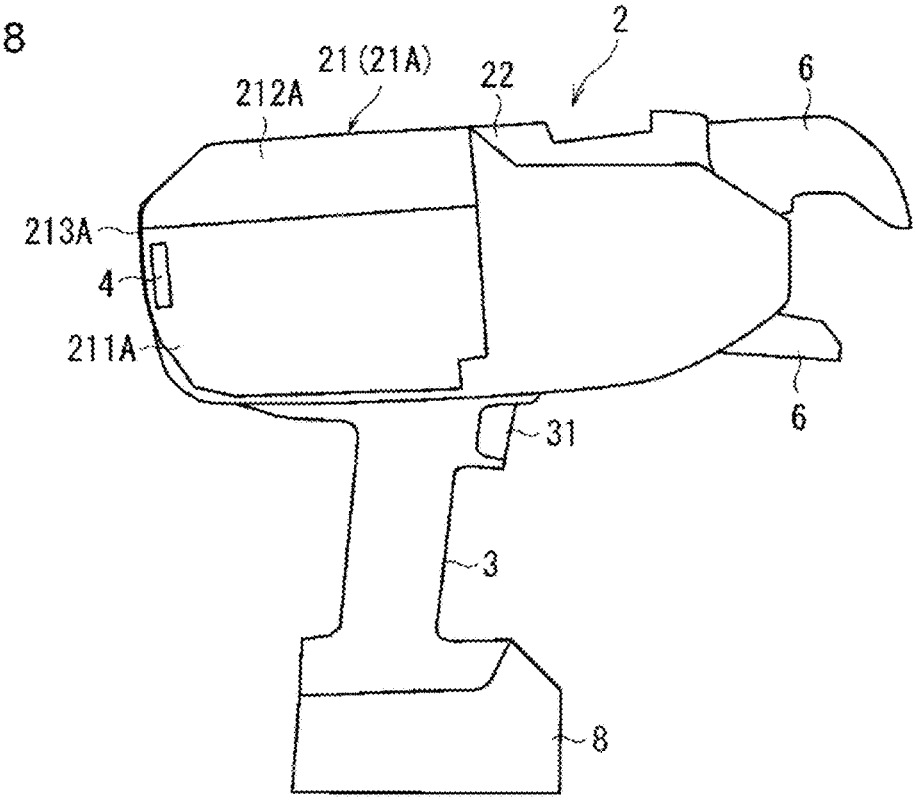
FIG. 8 illustrates a schematic side view of a rebar tying tool in another example.

FIG. 8 is a schematic side view of a rebar tying tool 1A in another example. The rebar tying tool 1A has the same structure as the rebar tying tool 1 except the structure of the reel housing 21. The reel housing 21 in the rebar tying tool 1A may hereafter be referred to as a reel housing 21A. The position of the reel housing 21A in the rebar tying tool 1A is the same as the position of the reel housing 21 in the rebar tying tool 1.

The reel housing 21A includes a box 211A, and an open-closed member 212A that is pivotable up and down. The box 211A has an upper opening and accommodates the reel 5. Similarly to the rebar tying tool 1, the front wall of the box 211A has an opening that connects to the internal space in the tying-unit housing 22. The wire 52 drawn from the reel 5 is fed into the tying-unit housing 22 through the opening.

The open-closed member 212A to be open or closed can cover the upper opening in the box 211A. The open-closed member 212A may also be referred to as a cover. The open-closed member 212A is pivotally connected to, for example, the box 211A with the hinge 213A in between. More specifically, for example, the hinge 213A may connect a rear end of the open-closed member 212A to a rear end of the box 211A in a manner pivotable about the axis of pivot in the right-left direction. This allows the open-closed member 212A to be open and closed like a lid.

Figure 9:
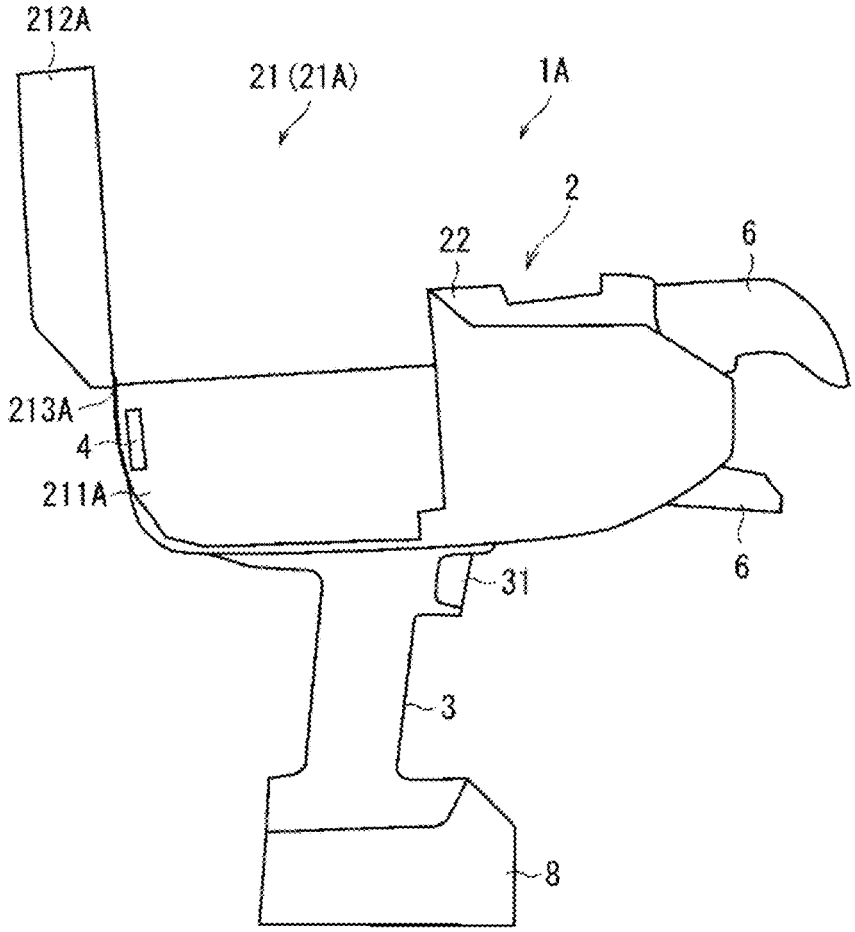
FIG. 9 illustrates a schematic side view of the rebar tying tool in another example, with its open-closed member being open.

FIG. 9 is a schematic side view of the rebar tying tool 1A in an example, with its open-closed member 212A being open. With the open-closed member 212A open, the box 211A is open upward, allowing the operator to attach or detach the reel 5 through the upper opening of the box 211A.

This rebar tying tool 1A also includes the antenna 4 located in the reel housing 21A. This structure also allows more reliable communication, similarly to the rebar tying tool 1. The reel housing 21A may include the antenna 4 at any location. For example, the antenna 4 may be located in a rear area of the reel housing 21, in an upper area of the reel housing 21, or in one of the side walls (walls) of the box 211A more away from the torsion motor 741. The antenna 4 may be located on one surface of or inside the box 211A in the reel housing 21A, or on one surface of or inside the open-closed member 212A.

The antenna 4 may be mounted to avoid overlapping the reel 5 in the reel housing 21 (refer to FIG. 9).

The rebar tying tool 1 has been described in detail as above, but the foregoing structures are illustrative in all respects, and the disclosure is not limited to the above structures. All the features of embodiments and the modifications described above may be combined in use unless any contradiction arises. Many modifications not specifically described above may be implemented without departing from the scope of the disclosure.

The invention claimed is:

1. A rebar tying tool, comprising:
a tying tool body; and
a grip extending from the tying tool body, and configured to attach a battery covered with a first housing, wherein
the tying tool body comprises:
a second housing, being different from the first housing, including
a reel housing configured to house a reel on which a wire for tying is wound, and
a first wall;
a guide located frontward from the reel housing to guide the wire drawn from the reel into a loop;
a feeder motor configured to feed the wire drawn from the reel;
a torsion motor configured to twist the wire drawn from the reel;
an antenna; and
a communication circuit configured to wirelessly communicate, through the antenna, with devices external to the rebar tying tool, and
the first wall separates the torsion motor and the antenna in a first direction, wherein the first direction is parallel to a rotation axis of the reel.

2. The rebar tying tool according to claim 1, wherein
the antenna is located in an area nearer a rear end of the reel housing than a front end of the reel housing.

3. The rebar tying tool according to claim 1, wherein
the antenna is located in an area nearer an upper end of the reel housing than a lower end of the reel housing.

4. The rebar tying tool according to claim 1, wherein
the first wall has a shape of a plate and has a thickness in the first direction.

5. The rebar tying tool according to claim 1, wherein
the grip is configured to detachably attach the battery.

6. The rebar tying tool according to claim 1, wherein
the first wall further separates the torsion motor and the communication circuit in the first direction.

7. The rebar tying tool according to claim 1, wherein
the tying tool body further comprises a control circuit configured to control the feeder motor.

8. The rebar tying tool according to claim 7, wherein
the antenna is mounted on a first substrate, and
the control circuit is mounted on a second substrate different from the first substrate.

9. The rebar tying tool according to claim 8, wherein
the communication circuit is mounted on the first substrate.

10. The rebar tying tool according to claim 1, wherein
the first wall is located between the torsion motor and the antenna in the first direction.

11. The rebar tying tool according to claim 1, wherein the first wall physically separates the torsion motor and the antenna in the first direction.

12. The rebar tying tool according to claim 1, wherein
in a perspective view of the rebar tying tool in an up-down direction perpendicular to a front-rear direction in which the wire is fed out of the rebar tying tool, a virtual straight line extended from the guide in the front-rear direction intersects the torsion motor.

13. The rebar tying tool according to claim 1, wherein
the guide is located at a front end of the second housing,
the feeder motor, the torsion motor and the communication circuit are located inside the second housing, and
the antenna is located inside the second housing or on a surface of the second housing.

* * * * *